US005152523A

United States Patent [19]

Keen

[11] Patent Number: 5,152,523

[45] Date of Patent: Oct. 6, 1992

[54] EXERCISE WEIGHT DEVICE FOR VARYING FORCE DURING EXERCISE MOTION

[76] Inventor: Robert Keen, 54 Central Ave., Demarest, N.J. 07627

[21] Appl. No.: 534,470

[22] Filed: Jun. 7, 1990

Related U.S. Application Data

[60] Division of Ser. No. 418,085, Oct. 6, 1989, Pat. No. 4,949,955, which is a continuation of Ser. No. 221,338, Jul. 19, 1988, abandoned, which is a continuation of Ser. No. 931,836, Nov. 18, 1986, abandoned.

[51] Int. Cl.[5] ..... A63B 21/06

[52] U.S. Cl. ..... 482/93

[58] Field of Search ..... 272/67, 74, 75, 72, 272/117, 118, 119, 122, 123, 125, 126, 128, 137, 138, 143, 93

[56] References Cited

U.S. PATENT DOCUMENTS

| | | | |
|---|---|---|---|
| 1,969,165 | 8/1934 | Turner | 272/93 X |
| 3,119,614 | 1/1964 | Berry | 272/125 |
| 3,427,020 | 2/1969 | Montour et al. | 272/119 |
| 3,559,987 | 2/1971 | Pear | 272/118 |
| 3,752,423 | 8/1973 | LaLadne | 272/118 X |
| 3,858,873 | 1/1975 | Jones | 272/117 |
| 4,290,597 | 9/1981 | Schleffendorf | 272/117 |
| 4,384,714 | 5/1983 | Kimura | 272/119 |
| 4,505,474 | 3/1985 | Mattox | 272/117 X |
| 4,682,774 | 7/1987 | Holy | 272/123 X |
| 4,690,399 | 9/1987 | Hatashi | 272/122 |

OTHER PUBLICATIONS

Advertisement for the "Iso-Ciser Kit" in the New York Times, Jul. 1963.

The Nautilus Bodybuilding Book, pp. 28-35, Date Unknown.

*Primary Examiner*—Robert Bahr

*Attorney, Agent, or Firm*—Sheldon H. Parker

[57] ABSTRACT

A weight lifting device which allows for varying, in a predetermined manner, weight resistance during exercise motion. The device includes a plurality of weight units which are capable of being flexed relative to one another at a plurality of points along at least a substantial portion of the device. The weight lifting device can include a plurality of weighted sections, each of which include a flexible elongated hollow member. At least one weighted section can include removable closure means at said second end which provides for removal of, or filling with, a high density, flowable substance.

3 Claims, 5 Drawing Sheets

FIG 1
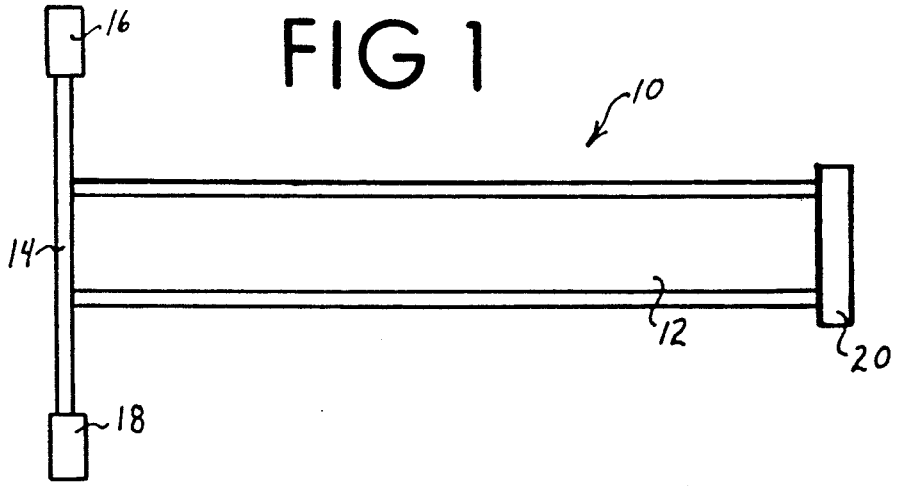
FIG 4
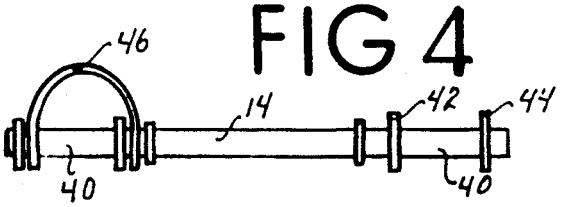
FIG 5
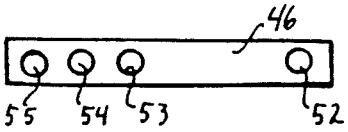
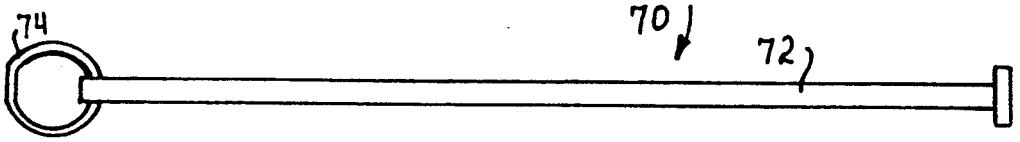
FIG 7
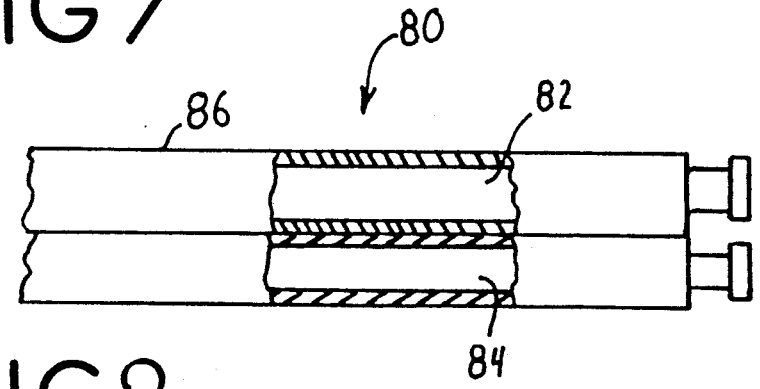
FIG8
FIG 6
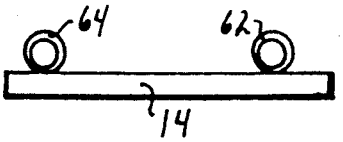

FIG 17
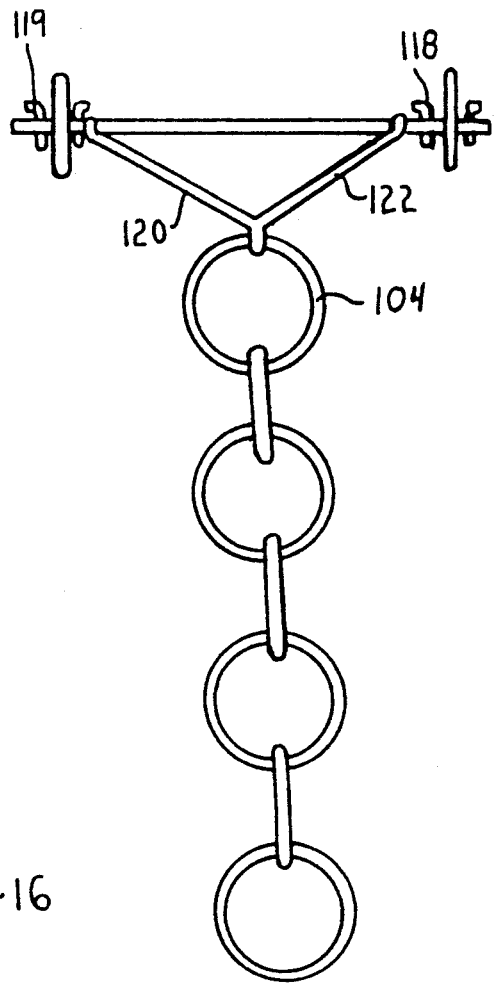
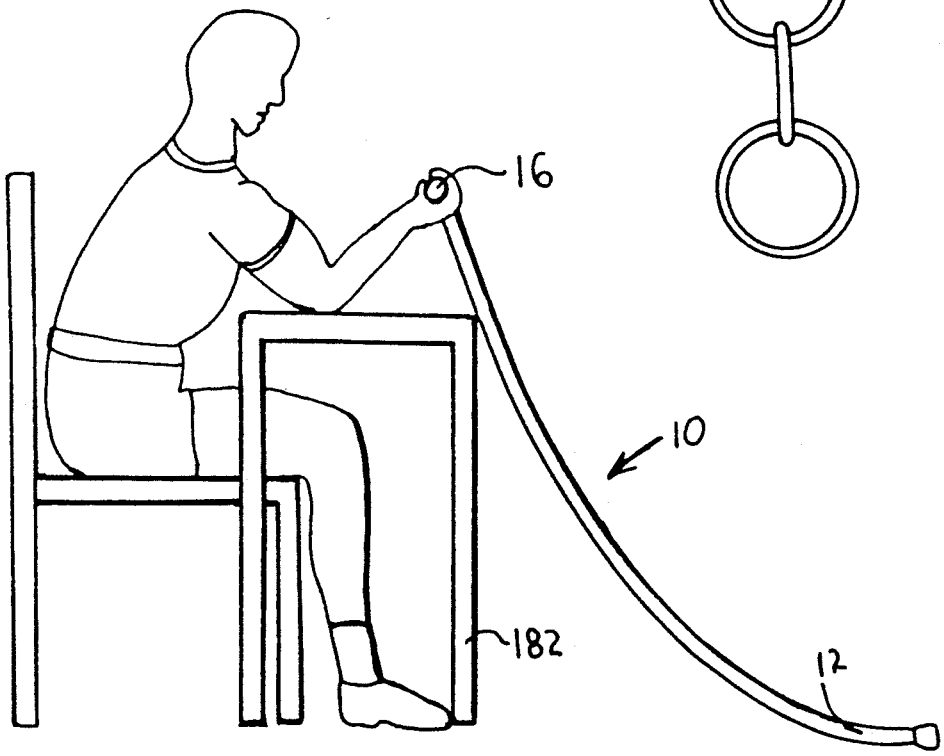
FIG 16

EXERCISE WEIGHT DEVICE FOR VARYING FORCE DURING EXERCISE MOTION

CROSS REFERENCE TO RELATED APPLICATIONS

This application is a divisional of application Ser. No. 07/418,085, filed Oct. 6, 1989, now U.S. Pat. No. 4,949,955, which is a continuation of application Ser. No. 07/221,338, filed Jul. 19, 1988, now abandoned, which is a continuation of application Ser. No. 06/931,836, filed Nov. 18, 1986, now abandoned.

BACKGROUND OF THE INVENTION

1. Field of the Invention

This invention relates to a unique, economical exercise device which allows the user to conveniently perform variable resistance type exercise, Embodiments of the instant exercise unit can be transported in a suitcase or brief case and easily stored in a small area.

2. Brief Description of the Prior Art

It has been known for some time that exercise is a basic requirement to the health of a person's heart and that consistent moderate exercise can prevent heart attacks. Studies have now proven that exercise can help more than the heart. Exercise increases the body's ability to use oxygen (VO2), a body function which normally begins to decline about age 20. Studies have shown that by maintaining a high VO2 ability the body can slow down the aging process dramatically. Exercise will also increase the amount of blood supplied to the skin cells, removing waste products, bringing nourishment and, according to aging studies, decrease the number of wrinkles. Exercise not only improves muscle tone but appears to help in reducing high blood pressure thereby lowering blood-cholesterol levels and improving blood sugar levels in diabetics. It is recommended that a person exercise 30 to 60 minutes per day, with a minimum of 12 minutes of aerobics maintaining the heart rate at its "target zone" (75 to 80% of the maximum heart rate).

Obesity, a far too common problem in affluent countries, can be greatly assisted by exercise. Regular exercise burns off calories as well as assists in the primary weight loss of fat and not muscle. Weight loss strictly by diet alone, can cause loss of lean tissue as well as fat.

A recent advertising supplement written by the American Medical Association states that:

> "The National Institute of Health calls exercise the most effective anti-aging "pill" even discovered. Scientific studies continue to demonstrate the many health-inducing aspects of regular physical activity."

Exercise also can help heal the body. This means that in some instances, it can help correct physiological illness.

- Mental health—Studies find exercise an antidote in certain cases of depression.
- Diabetes—Regular physical activity can help eliminate or reduce some patients' need for insulin.
- Hypertension—Regular exercise can help lower high blood pressure in some individuals.
- Heart disease—It can help reduce incidence of heart attack, and may even encourage more rapid recovery in heart attack victims.

- Arthritis—Through certain exercises, patients can sometimes preserve a full range of movement.

Exercise trends have changed dramatically over the last few years. During the 70's it was jogging, during the 80's it is working out.

The best known method of developing the strength, size, and endurance of particular muscles is the lifting of free weights, such as barbells. However, free weights have basic limitations, One of these being that they do not provide proper variable resistance. According to Dr. Ellington Darden, Research Director of Nautilus, due to the "manner in which they function and because of their basic shape", to become stronger muscles should be subjected to "increasing resistance as they contract". However, most barbell exercises do not provide this increase in resistance. In fact, in many of the exercises the resistance decreases as the muscle contracts.

The Nautilus exercising concept, which is popular in many health clubs and exercise gyms throughout the country, overcomes the lack of proper variable resistance in the barbell. In the Nautilus system, variable resistance is achieved through the use of cams. The need for variable resistance is based on the biological fact that the effective strength of a muscle is not the same in every position. For example, when an arm is fully extended sideways, it takes very little resistance to prevent the arm from being rotated upward. However, as the arm rotates at the elbow, the effective leverage increases and the muscle is enabled to apply its full force. The Nautilus system applies resistance to the muscles through the full range of their movement thereby exercising with the muscle, not against it. This method permits muscles to be strengthened much more efficiently than by free weights.

The goal for every serious "exerciser" is to build body muscle to a desired point. Muscle strength and endurance come from working muscles against some form of resistance. Muscle, however, doe not build beyond the level of resistance to which it is subjected, no matter how many repetitions are done. The Nautilus system increases the weight after a certain number of repetitions are completed, thereby increasing the amount of muscle.

Nautilus equipment, however, has a few major disadvantages in that:

a. it is expensive;
b. it is not portable since the machines are extremely heavy and a complete setup typically requires over 1000 square feet; and
c. a different machine is needed for each muscle group; (consequently, about 20 different machines are available).

The expense of each machine, the multitude of machine types needed for different exercises, and the amount of space needed for each machine makes the system not feasible for use at home by most consumers. Thus, to obtain the advantage of a full Nautilus program an individual would have to join a gym or health club. This again can be expensive and often nut used to its full extent due to time pressures.

An exercise alternative has been home gyms. Last year more than $1 billion was spent by consumers on home exercise equipment. While not providing the type of exercise that the Nautilus provides, they are convenient in that a few minutes of "free" time can be productively used for exercise. Again, however, the home gyms can be expensive and, in most cases, do not provide variable resistance during the exercise motion.

SUMMARY OF THE INVENTION

In the instant invention the disadvantages of size and expense are overcome and a small, easy to use exercise device with the variable resistance advantage of the Nautilus style of exercise is provided.

DESCRIPTION OF THE DRAWINGS

The advantages and objects of the invention will become apparent and the invention will be more fully understood from the following specification, particularly when read in conjunction with the drawings, wherein:

FIG. 1 is a perspective of the unit in accordance with the present invention;

FIG. 4 is a side view of the handle of the instant invention incorporating ankle straps;

FIG. 5 is a top view of an ankle strap;

FIG. 6 is a side view of an alternate handle;

FIG. 7 is an partial top view of an additional embodiment of the invention;

FIG. 8 is a partial cut away of an alternate embodiment of the weight tube of the instant invention;

FIG. 16 is a side view of the instant invention in use in the sitting position; and FIG. 17 is a further embodiment of FIG. 12.

DETAILED DESCRIPTION OF THE INVENTION

Figure 2:
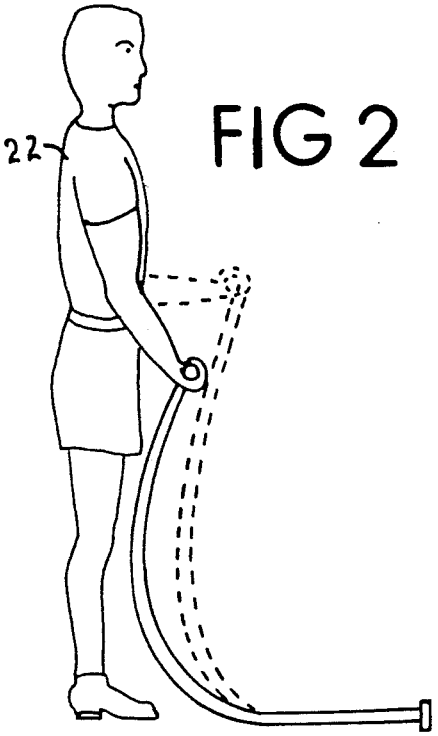
FIG. 2 is a side view of the instant invention in the starting position for use.

The device contains a handle and a weight section. The weight section of the device is composed of discrete parts attached to each other by a flexible cord or other flexible member. Initially most of the weight section is supported by the floor. As the exercise motion progresses more of the weight section is removed or lifted from the floor, thus increasing the effective amount of weight being lifted.

FIG. 1 illustrates the assembled weight unit 10 of the instant device extended to its full length as in preparation for exercise. The weight tube 12 is constructed in a strong, nondeformable, flexible material, such as rubber, heavy gauge plastic, etc. The material of the weight tube 12 must be able to bend at a minimum of a 90 degree curvature with the ideal being for the weight tube 12 to be able to fold or roll upon itself. The weight tube 12 is a hollow structure with a length of approximately 5 to 10 feet. For greatest efficiency, the weight tube 12 should be approximately equal to the user with arms stretched over his head. It is obviously impractical to manufacture a different size for each user; it is readily feasible to provide at least two sizes of the assembled weight unit 10. The entire unit can be "color coded" as to size and number of interior weight tubes, as discussed hereafter.

The cross section of the weight tube 12 can be any desired shape, round, square, oblong, etc., however the round provides the advantage, in the first and second embodiments, that the weight filler tube cap 20 can be affixed to the weight tube 12 by means of a conventional, easy to manufacture screw type method. For ease of description, the round cross section will be referred to in the following description of the first and second embodiments, however this does not in any way limit the scope of the invention. The embodiment set forth in FIGS. 9 and 10 most conveniently uses a rectangular cross section, however again, this is not intended to limit the invention to this one configuration.

As illustrated in FIG. 1, the handle 14 is affixed to the weight tube 12 by means commonly known in prior art and can be dependent upon the shape and material of manufacture. The assembled weight unit 10, depending upon the material, can also be manufactured as a one piece unit. The handle 14 must be securely affixed to the weight tube 12 at right angles in a manner which will not allow for slippage, sliding or other such movement. Rotational movement can be provided as well known for use with barbells. Although slippage between the handle 14 and the weight tube 12 can create loss of effectiveness and make use of the device awkward, the aforenoted rotational movement can effectively facilitate the movement of the hands from the position of FIG. 2 to the position of FIG. 3. The handle grip 16 and handle grip 18 are commonly known in the exercise art and are added to increase grip and comfort. The desired rotational movement can most effectively be achieved by providing for rotation of the handle grips 16 and 18 about the handle 14.

The device of the instant invention can be permanently filled with the required high density substance. To fill the unit, the weight tube cap 20 is removed from the weight tube 12 and a heavy, that is, a high specific gravity pourable substance, such as sand, water, lead pellets, etc., is poured into the weight tube 12. The most convenient and effective substance is water, as permanent storage of the substance is not required. Moreover, partial filling of the weight tube 12 will affect the exercise, depending upon position and use, as further discussed herein. By allowing for the filling substance to be removed, the assembled weight unit 10 becomes easily stored and light in weight to transport. Once the substance is removed, the unit can be folded or rolled for storage. This mobility and size reduction allows for the frequent traveler to continue exercising during trips of the apartment dweller to store the unit when required. Unlike conventional barbells, even in its filled form, the assembled weight unit 10 can easily be stored under a bed or couch, etc.

Figure 3:
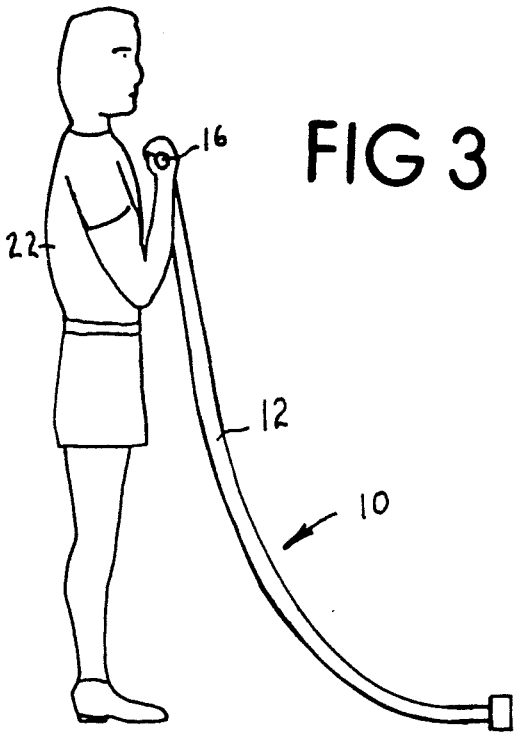
FIG. 3 shows an additional side view of the instant invention in use.

As the muscles get stronger, both the constant weight and variable weights can and should be increased. The constant weight can be increased by use of a dumbbell type handle similar to an adjustable weight dumbbell with the ability to add or remove weight discs, as disclosed in FIG. 11. The handle 14 can be manufactured of a strong, rigid material with a hollow interior and can be filled with variable amounts of material to bring it to the desired constant weight. The hand grips 16 and 18 can be used to hold the material within or on the handle 14. FIGS. 2 and 3 illustrate the instant device in one of its many uses. In FIG. 2 the user 22 is standing, arms relaxed, with the assembled weight unit 10 held at handle grip 16 and handle grip 18, palms facing up. The weight being supported by the user at that point in time can be, for example, only about one third or one half of the total weight of the completely filed assembled weight unit 10. If, however, the assembled weight unit 10 is only partially filled with the substance the percentage of weight being supported, as illustrated in FIG. 2 would be proportionally less. FIG. 3 shows the user 22 having raised his hands to his chest, bending at the elbows. Substantially more of the assembled weight unit 10 has now been lifted off the ground, providing maximum lifting weight for this particular exercise. The lifting weight gradually increased over that of FIG. 2 as the arms were lifted and the muscle strength became greater. If the user 22 so desired at this point, the arms could be lifted straight over the head, providing a second phase to this particular exercise.

After bringing the hands to their maximum lifting point as illustrated in FIG. 3, they would then e lowered again, providing contraction of the "opposite" muscles. As with the lifting of the assembled weight unit 10, returning to the starting position reduces the weight as the leverage ability of the muscles reduces.

The position described above is only one of several which can be used to exercise the arms with the instant invention. The above exercise can e done in a seated position, as illustrated in FIG. 16. In this embodiment, the user sits resting his elbows on a table 182 and lifts the weight unit 10 without movement of the upper arm. It is recommended that the weight tube 12 be filled to its near full capacity in this position in order to get the most effective results. It should also be noted that any of the embodiments descried herein can be used in this position. Most importantly, the foregoing illustrates that the amount of weight which is being lifted or lowered dynamically changes during the exercise. Thus, the amount of weight being handled is caused to vary in relation to the increasing or decreasing effective strength of the muscles in use and provides a dynamic consistency.

Figure 15:
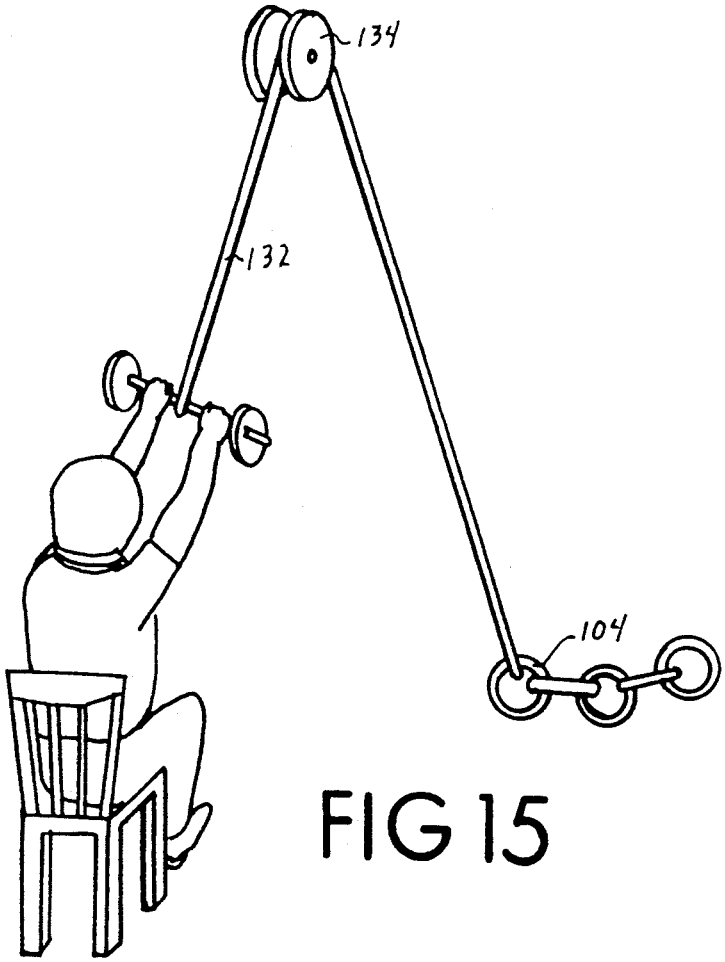
FIG. 15 is a perspective view of another embodiment of the invention.

Another exercise can be commenced with the arms straight out from the body, parallel with the floor, preferably with the elbows supported by a table or similar structure, corresponding to the system as illustrated in FIG. 15. Then, as the elbow is bent, the weight of the instant invention is progressively lifted from the ground; thus as the motion progresses, more weight is being lifted. After bringing the forearm to its highest point it would then be slowly lowered again. Returning to the starting position reduces the weight as the leverage ability of the muscle decreases. Additionally, the arms can be rested on the knees and the wrists used to lift and lower the assembled weight unit 10. The weight tube 12 would be filled to its maximum in order to fully exercise the appropriate muscles.

FIG. 4 illustrates the alternate grips 40 on the handle handle 14. The grips 40 is provided with ridges 42 and 44 which extend above its surface. The ankle band 46, as illustrated in FIG. 5 is provided with holes hole 52, 53, 54 and 55 which have a diameter larger than the handle 14 and smaller than the ridges 42 and 44. The hole 52 is positioned at one end of the ankle band 46 with the holes 53, 54 and 55 spaced along with length of the other end. The hole hole 52 is forced over the ridge 44 and positioned next to ridge 42. One of the remaining holes is then slipped over the ridge 44 forming a loop. The multiple holes 53, 54 and 55 provide variable spacing depending upon the size of the user. The foregoing uses three holes 53, 54 and 55 in description, however this in no way limits the number of holes which can be provided. The above is a method which is well known in the prior art and the attachment of ankle bands is not limited to the above description.

An alternative attachment means for the ankle straps, as shown in FIG. 6, incorporates attachment rings 62 and 64 which can be affixed to the handle 14 at time of manufacture. The attachment methods can be any of many well known in the prior art. Standard ankle bands, as used with many types of exercise equipment, can then be attached via a conventional snaplock device. The use of the ankle bands 64 provide the user with the ability to use the above assembled weight unit 10 to exercise leg and stomach muscles. The user can lie on his stomach, with ankles attached to the handle 14 via the ankle bands 64 and lift his lower legs, bending at the knees. The legs should then be returned to starting position. This exercise can be performed on either on the floor or on a raised surface, such as an exercise bench. To exercise the stomach and upper thigh muscles the assembled weight unit 10 can be used similarly to leg weights in leg lifts. Again the advantage being the increased weight resistance at the point of greater leverage. These are only some of the diverse uses of the instant invention and the user can easily adapt the instant invention for overall exercise or to concentrate on specialized areas.

FIG. 7 illustrates an additional embodiment of the instant invention. The single grip weight unit 70 has the same single grip weight tube 72 as the assembled weight unit 10, however the length of the single grip weight tube 72 would be, in the preferred embodiment, shorter. The single grip handle 74 preferably is a semicircle with a flat grip section. This design of grip is well known in the exercise prior art and is one of the most comfortable for the user. The single grip weight unit 70 can be used with other shaped handles and is a manufacturer's choice.

The single grip weight unit 70 can be used in those exercises which require the arms and/or legs to be exercised separately and where a bar type grip would not be appropriate. An example exercise would be side leg lifts, either standing or prone.

FIG. 8 illustrates an alternative embodiment corresponding to assembled weight unit 10. The weight tube is formed of multiple sections, chamber 82 and chamber 84, forming multiple weight tube 86. As previously mentioned, one advantage to the Nautilus concept is the ability to increase the lifting weight. While the change from a light weight to a heavy weight filling substance will provide added weight, great inconvenience and limitations would be encountered. Moreover, for some users the maximum weight achieved in a single tube system would not be adequate. The entire outer size of the multiple weight tube 86 can be larger than that of the weight tube 12, of FIG. 1. Nevertheless, since it can be made of the same material, it would still have the storage advantages of a smaller unit.

While the use of two sections is shown for illustrative purposes, it should be readily apparent that any desired number of sections can be used. Further, the sections can be of differing sizes and shapes so as to provide further customization in regard to minimum and maximum weight and progressive weight change. The multiple weight tube 86 uses the same filling concept of the weight tube 12. However, the use of multiple tubes allows for greater weight variation by partly or totally filling various combinations of sections.

Figure 10:
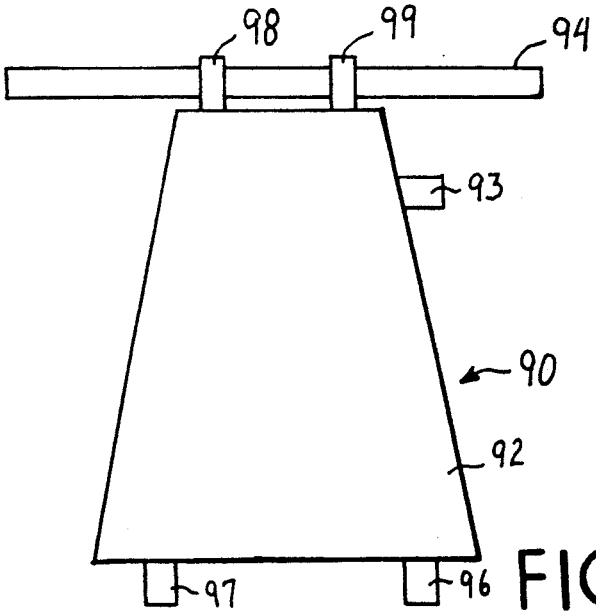
FIG. 10 is another top view of the embodiment of FIG. 9.
Figure 9:
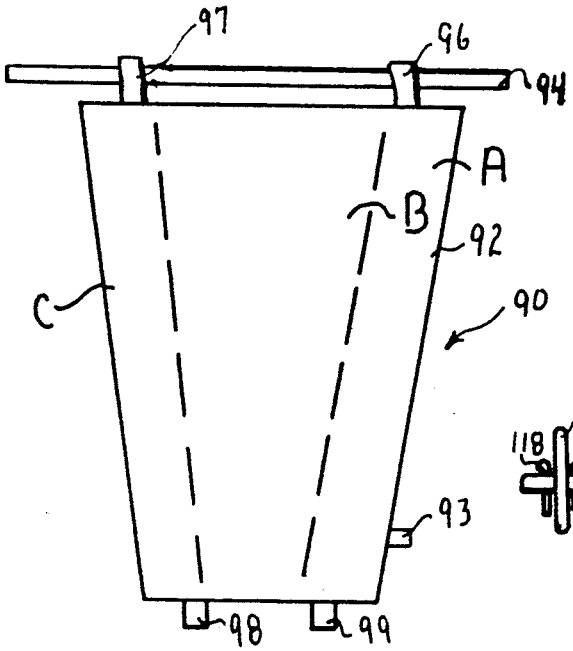
FIG. 9 is a top view of alternate embodiment of the invention.

FIGS. 9 and 10 illustrate an alternate embodiment of the instant invention which allows for a greater variance in weight than the previous embodiment. Trapezoidal weight device 90 is formed as a modified triangle, with two ends parallel of different lengths. The handle 94 is connected to the triangular weight tube 92 by means of connector grips 97 and 96. The connector grips 96 and 97 must be securely affixed to the triangular weight tube 92 while allowing for removal the handle 94. It is suggested that a high grip material, as well known in the art, be utilized to prevent the handle 94 from slipping within the connector grips 96 and 97. Connector grips 98 and 99 are placed at the opposite end of the triangular weight tube 92 of the connector grips 96 and 97 and are affixed in the same manner as the connector grips 96 and 97. The filler cap 93 is placed at the side of the triangular weight tube 92 and is used as the weight tube cap 20 previously described. FIG. 10 illustrates the embodiment of FIG. 9 in its reversed position. The handle 94 has been removed from the connector grips 96 and 97 and placed in connector grips 98 and 99, reversing the entire unit. The filler cap 93 is shown at the side of the triangular weight tube 92 for illustration, however the cap can be placed at any position convenient for manufacture.

The modified triangular configuration of the embodiment illustrated in FIGS. 9 and 10 allows for a greater variation in weight resistance than previously described embodiments. The triangular weight device 90 as illustrated in FIG. 9 provides the use with a lower proportion of weight increase as the user starts off with the larger portion of the weight held in the initial position. As illustrated in FIG. 10, the weight increase is proportionally greater as the unit is lifted due to the wider proportions of the triangular shape. As previously noted, the sue of a plurality of individual sections, such as sections A, B, and C of FIG. 9, would provide the ability to provide further customization in regard to minimum and maximum weight and progressive weight change.

Figure 11:
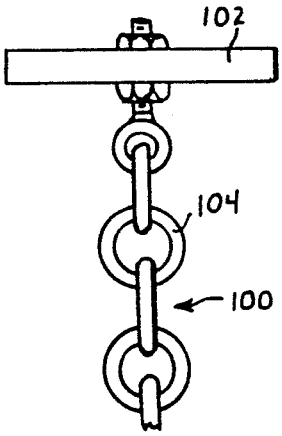
FIG. 11 is an additional embodiment of the invention.
Figure 12:
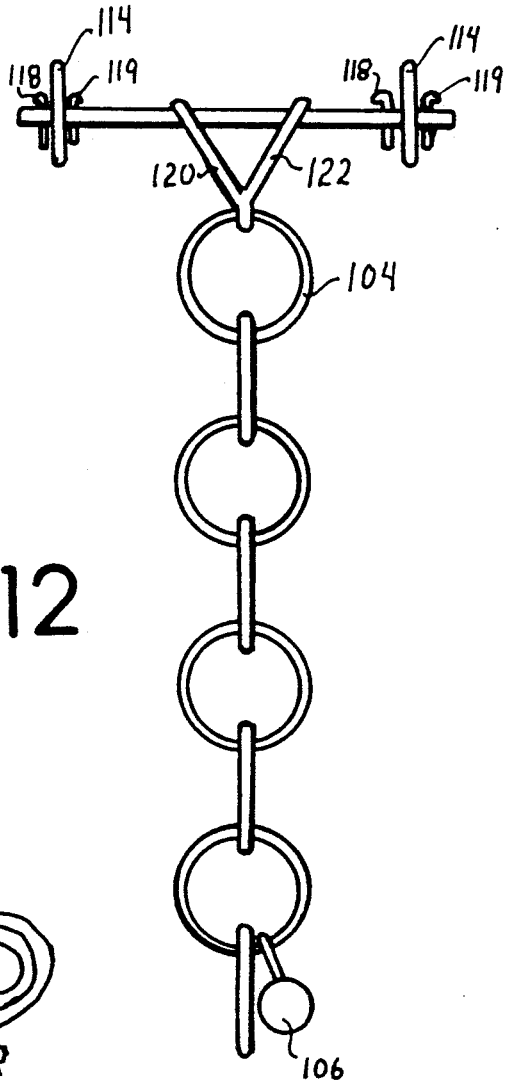
FIG. 12 is a further embodiment of the invention.

The additional embodiment illustrated in FIG. 11 utilizes weighted rings, or heavy links, interconnected to form a chain. The weight rings 104 are connected to the handle 112 by a method convenient for manufacture. The weight rings 104 can be a consistent weight throughout the entire weight chain 100 or can be placed in a graduated weight order. If so desired, the weight rings 104 can be manufactured with a portion or all of the rings removable to allow for increase or reduction of lifting weight as well as location of greater resistance. Additional control over the amount of weight and how it varies during the movement, can be obtained by attaching weights 106 to the weighted rings 104, as illustrated in FIG. 12. The weights 106 would initially rest on the floor, adding to the weight as the device is lifted. The weights 106 can be of a solid, weighted material, as preferred for manufacture, or containers which can be filled with water, sand, steel shot, etc. Additional constant weight can be obtained by the addition of a dumbbell type handle 112. The dumbbell handle 112 consists of a bar 116 onto which weights 114 are placed and secured by means of pins 118 and 119. The bar 116 must be wide enough to allow for the proper positioning of both hands, approximately shoulder width. The pins 118 and 119, or other securing device, must be used in order to prevent the weights 114 from either falling off or sliding toward the center. Alternatively, the dumbbell can be of a constant weight type, adding one increased weight per set of dumbbells. The dumbbells can also be sized for use with one hand. The method for securing the weighted rings 104 to the dumbbell 112 can vary. The bar 116 can be provided with rings (not shown) as described in FIG. 6 and the weighted rings 104 attached via snap hooks or the weighted rings 104 can be permanently attached to the bar 116 at time of manufacture. Additionally, the weighted rings 104 can be attached directly to the handle, as illustrated in FIG. 11 or guide lines 120 and 122 can be utilized as illustrated in FIG. 12. The guide lines 120 and 122 can be attached to the dumbbell 112 at varying positions. FIG. 12 illustrates the guide lines 120 and 122 connected so as to allow the user's hands to be placed between the guide lines 120 and 122 and the pins 118 and 119. Alternatively, FIG. 17 illustrates the guide lines 120 and 122 positioned adjacent the pins 118 and 119, the user thereby positioning his hands between the two guide lines 120 and 122. The above are only a few ways which the weighted rings and the handles can be attached, additional connector means are well known in the prior art and the above should not, in any way, limit the scope of the invention.

An alternate embodiment to the above would be to substitute a light chain or simple cord for the weighted rings 104, with the disclosed weights attached thereto. In this case almost all of the added weight during the movement will be from the attached weights.

Figure 13:
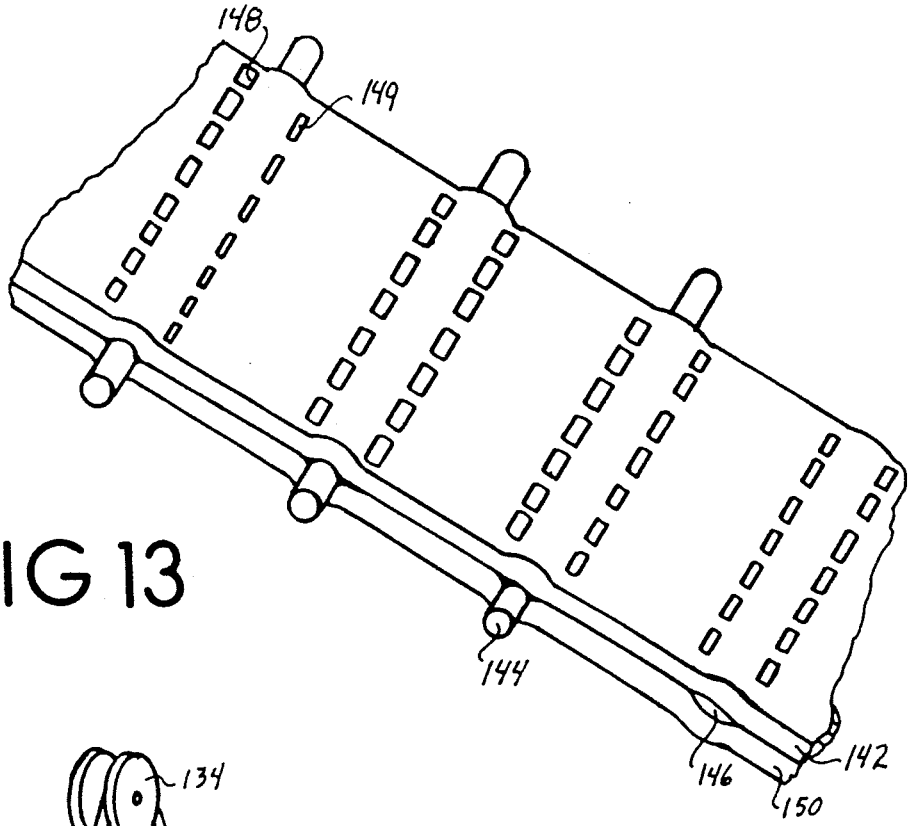
FIG. 13 is a fragmentary perspective view of a still further embodiment of the invention.

A further embodiment is illustrated in FIG. 13 wherein two strips of strong, flexible material 142 and 150 are stitched together at stitch line 149 and 148 to form receiving areas 146 for the weighted bars 144. The weighted bars 144 are able to be removed from the receiving areas 146 to be replaced with different weight bars, thereby allowing for extreme variances in weight. The material 142 and 150 used herein must be of a tear resistant nature, strong and flexible. Canvas, heavy denim or vinyl are only a suggested few. Care must be taken in manufacture to dimension the receiving areas 146 so that while allowing for removal of the weighted bars 144 there is sufficient frictional fit to prevent the bars from slipping out when in use. Alternatively, a bolt type of configuration can be used to prevent the weighted bars from slipping out of their sleeves. That is, a bolt head can be provided at one end and a threaded nut can be provided at the other end. Other well known mechanisms, such as cotter pins, can be used to prevent slippage of the weights.

Figure 14:
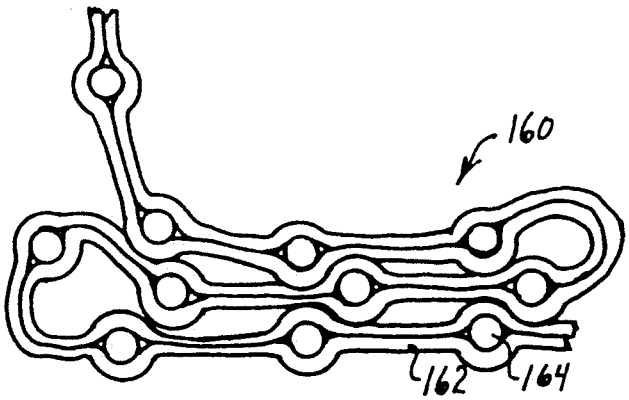
FIG. 14 is a fragmentary side view of the embodiment of the embodiment of FIG. 13.

As illustrated in FIG. 14, the flexible connectors 162 link the weight rods 164 in such a manner that the weight rods can neatly stack one on top of the other during use, in a serpentine fashion. The weight unit 160 provides a weighted chain effect in much the same manner as the linked chains heretofore described. The fabric or cover 162 can be formed of a molded plastic, a heavy heat shrinkable plastic 162 or woven fabric, preferably of a synthetic fiber. The use of the plastic 162 provides the advantage of being able to be tightly conformed to the weight rods 164, reducing bulk while allowing for flexiblity. The multiple rod unit 160 differs from a standard chain in that each rod can be of a substantially greater weight than is readily attainable with an individual chain link, thus facilitating the use of greater resistance during lifting. Moreover, the unit is articulated in a manner which provides smoother flexing or movement about the interlinking regions. It should be understood that, as employed herein in describing the instant invention, the term articulate is intended to refer to a movable joint, as for example would be found in a hinge.

In some exercises, as the body part moves toward the floor the weight needs to be increased, the reverse of the methods described herein. An example of a muscle requiring this type of exercise is the tricep, the muscle which extends the arm at the elbow. FIG. 6 illustrates the instant device in use with this type of exercise. The weighted chains 104 are removed from the handle 102 and attached to one end of the pulley card 106. The pulley cord 106 is then pulled through or looped over a raised section 134. The raised section 134 can be in the form of a standard pulley attached to the wall, an eyelet screwed into the wall, a chinning bar, beam, open door, etc., thereby allowing the reverse exercise to be done without the purchase of expensive additional equipment. The handle 102 is then attached to the other end of the pulley cord 132. It is suggested that at the point of attachment of the pulley cord 132 to either the handle 102 or the weighted rings 104 that an adjustment means be provided for in order to allow for variance is height of both user and raised section 134. In the event the handle is not removable from the weighted device, as in the case of FIG. 1, an alternative pulley system is provided, as illustrated in FIG. 15. The pulley can be equipped with its own handle and attached to the weight device 10 by means of looped section or sections. The pulley and weight device can be attached to one another by many means as known in the prior art and any method can be utilized. One of the advantages of the pulley is the reversal of the resistance factor from increasing to decreasing or decreasing to increasing.

Many other exercises can be used with the instant device as either a supplement to gym workouts or as a complete system in itself. The assembled weight units can be manufactured at various lengths to allow for height or to vary with the type of exercise.

What is claimed is:

1. The method of exercise, comprising the steps of a- exerting a progressively increasing force against a predetermined increasing resistance, said increasing resistance having an increasing rate of increase, b- exerting a progressively decreasing force against a predetermined progressively decreasing resistance, said decreasing resistance having a decreasing rate of decrease, c- repeating step (a) and then repeating step (b), wherein said increasing resistance is provided by an articulated weighted member having a first end and a second end and interconnected sections capable of being progressively and repeatedly lifted directly from an initial position on a support surface and returned to said initial position, said interconnected sections having an increasing weight per unit length along at least a portion of their length from said first end to said second end.

2. The method of claim 1, wherein said resistance increases relative to increasing mechanical advantage of the user's muscle and said resistance decreases relative to decreasing mechanical advantage of the user's muscle.

3. The method of exercise, comprising the steps of a-exerting a progressively increasing force against a predetermined progressively increasing resistance, by lifting an articulated weighted member having a first end and a second end and interconnected sections capable of being progressively and repeatedly lifted directly from an initial position on a support surface and returned to said initial position, said interconnected sections having an increasing weight per unit length along at least a portion of their length from said first end to said second end thereby producing said predetermined progressively increasing resistance, said progressively increasing resistance having an increasing rate of increase, b-exerting a progressively decreasing force against a predetermined progressively decreasing resistance by lowering said articulated weighted member to said initial position, thereby producing said predetermined progressively decreasing resistance, said progressively decreasing resistance having an increasing rate of decrease, c-repeating step (a) and then repeating step (b).

* * * * *